US008046863B2

(12) United States Patent
Berti et al.

(10) Patent No.: US 8,046,863 B2
(45) Date of Patent: Nov. 1, 2011

(54) INTEGRATED MOP SYSTEM

(75) Inventors: Enzo Berti, Venice (IT); Marco Bizzotto, Padua (IT); Roberto Pellacini, Torrechiara (IT)

(73) Assignee: The Libman Company, Arcola, IL (US)

( * ) Notice: Subject to any disclaimer, the term of this patent is extended or adjusted under 35 U.S.C. 154(b) by 967 days.

(21) Appl. No.: 11/971,884

(22) Filed: Jan. 9, 2008

(65) Prior Publication Data

US 2008/0178405 A1 Jul. 31, 2008

Related U.S. Application Data

(60) Provisional application No. 60/884,868, filed on Jan. 12, 2007.

(51) Int. Cl.
*A47L 13/144* (2006.01)

(52) U.S. Cl. ..... 15/119.2; 15/116.1

(58) Field of Classification Search ..... 15/119.2, 15/116.2, 115, 118
See application file for complete search history.

(56) References Cited

U.S. PATENT DOCUMENTS

| | | | | |
|---|---|---|---|---|
| 3,727,259 | A * | 4/1973 | Wilson | 15/119.2 |
| 7,178,189 | B1 * | 2/2007 | Perry et al. | 15/119.2 |
| 2002/0029433 | A1 | 3/2002 | Libman | |

FOREIGN PATENT DOCUMENTS

| | | |
|---|---|---|
| CN | 2436094 | 6/2001 |
| NZ | 260882 | 8/1996 |
| WO | 9959459 | 11/1999 |
| WO | 2004062456 | 7/2004 |

OTHER PUBLICATIONS

Examiner's First Report on Patent Application No. 2008200163, dated Nov. 23, 2009.
Examination Report for Patent Application No. 565032, dated Feb. 27, 2009.
Office Action dated Dec. 31, 2010 for Chinese Patent Application No. 200810085661.3, 17 pages.

* cited by examiner

*Primary Examiner* — Shay Karls
(74) *Attorney, Agent, or Firm* — Banner & Witcoff, Ltd.

(57) ABSTRACT

In an embodiment, a mop includes a mop head and a shaft attached to the mop head. A handle is attached to the shaft by a pivot. An actuator member is coupled to the handle between a grip end and the pivot. Translation of the handle causes the actuator member to translate. In an embodiment, the pivot is offset from the shaft and arranged so that the shaft is located between the position where the handle is attached to the actuator member and the position where the handle is attached to the pivot. A stop may be provided to limit the translation of the handle. The actuator member is coupled a mop fiber base that supports mop fibers. The surface of the mop fibers may have a plurality of raised portions.

15 Claims, 14 Drawing Sheets

INTEGRATED MOP SYSTEM

CROSS-REFERENCE TO RELATED APPLICATIONS

This application claims priority to U.S. Provisional Application Ser. No. 60/884,868, which was filed on Jan. 12, 2007 and which is incorporated herein by reference in its entirety.

BACKGROUND

1. Field of the Invention

Embodiments of the invention relates to the field of mops, more particularly to the field of mops with an integrated wringer.

2. Description of the Related Art

As is known, the use of a mop can be an important part of maintaining a clean surface such as a floor. Most mops can be divided into one of two categories, those with an integrated wringer system and those without an integrated wringer system. As is known, both types have certain advantages for certain types of jobs. Mops with the integrated wringer system, however, have become increasingly popular for household tasks because a separate wringer is not required. Therefore, integrated solutions are typically less costly, may result in reduced contact with cleaning fluid and may take up less storage space. For example, a single multi-purpose bucket may be used with a mop that includes an integrated wringer system while a mop with a separate wringer may require that the bucket is made more heavy-duty and is configured in a particular manner.

In operation, a user can wet an integrated mop with a cleaning solution, wring out the mop with the integrated wringing system, mop a work surface and again wring out the mop as needed. Thus, existing integrated mops provide effective cleaning. However, improvements in how the wringing system of existing integrated mops function would be appreciated.

SUMMARY

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

In an embodiment, a mop includes a shaft with a mop head attached to the shaft. A sleeve is positioned on the shaft and a handle is movably mounted to the sleeve. The handle is coupled to an actuator member that is configured to extend through a hollow portion of the shaft. The actuator member is configured so that when the handle is translated, mop fibers coupled to the actuator member are pulled through compression members supported by the mop head. The sleeve may include a stop to prevent excessive translation of the handle. The sleeve may further include a shroud to partially guard the user from pressing against the actuator member while attempting to translate the handle.

BRIEF DESCRIPTION OF THE DRAWINGS

Embodiments of the invention are illustrated by way of example and not limited in the accompanying figures in which like reference numerals indicate similar elements and in which.

DETAILED DESCRIPTION

Figure 1A:
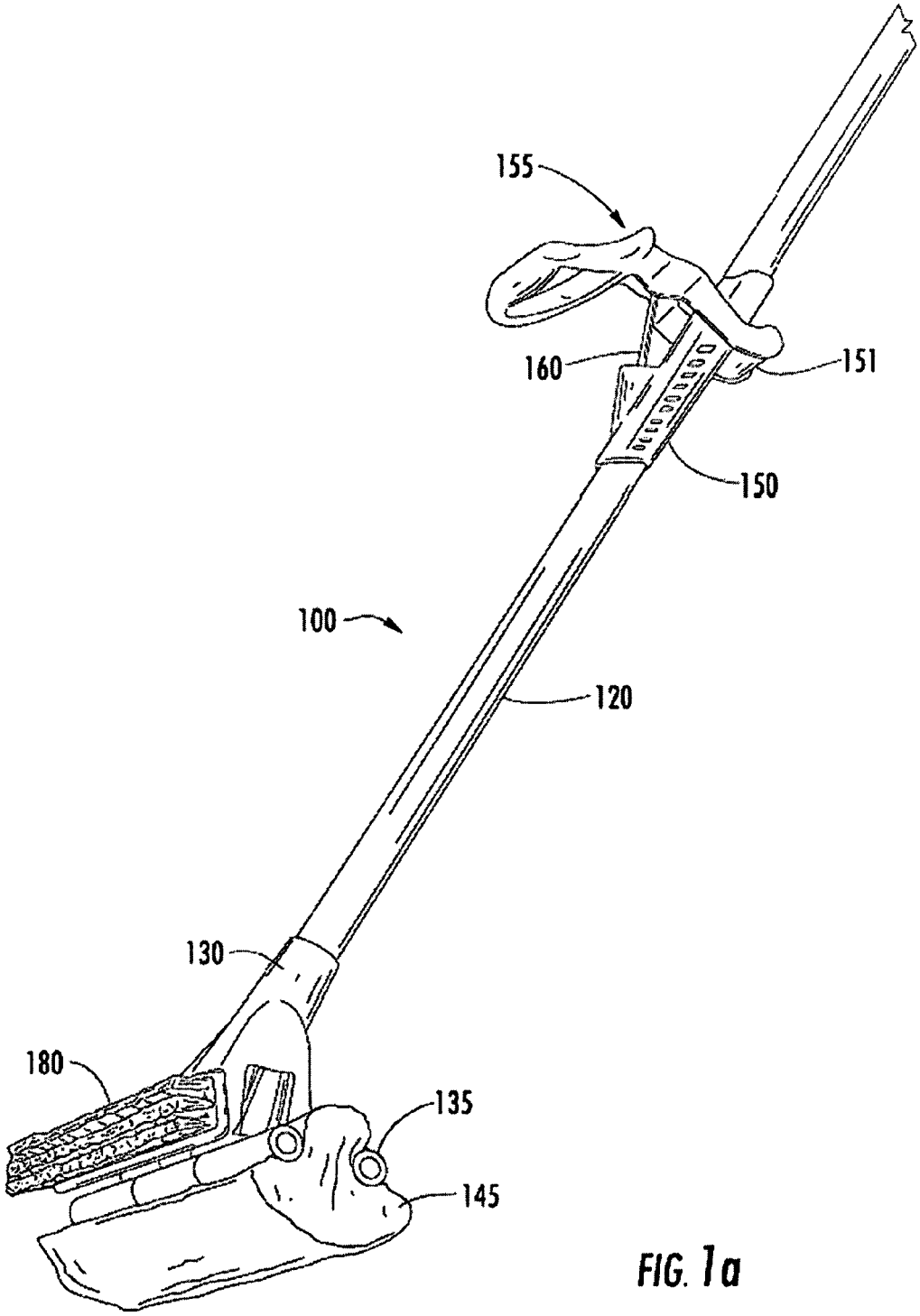
FIG. 1*a* illustrates an isometric view of an embodiment of a mop with a handle in a first position.

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope and spirit of the present invention. It is further noted that various connections are set forth between elements in the following description. It is noted that these connections in general and, unless specified otherwise, may be direct or indirect and that this specification is not intended to be limiting in this respect.

As is known, using a mop typically requires the user to wring out mop fibers periodically to expel liquid, such as cleaning solution, absorbed by the mop fibers. Typically, it is desirable to allow the user to use a mechanical assembly such as a lever so as to gain a mechanical advantage when wringing out the mop fibers. This allows the user to apply less force while achieving more thorough wringing of the mop fibers. While relatively large levers are possible when a separate ringer is used, an integrated mop (e.g., a mop with an integrated wringer) is somewhat limited by ergonomic and aesthetic issues.

FIGS. 1*a*-1*d* illustrate an embodiment of a mop 100. It should be noted however, that depending on the design and needs of the user, illustrated features may be omitted and other features may be added to various embodiments as desired. In addition, it should be noted that while certain features are described in detail and are helpful to provide the desired functionality, in general, the appearance of the mop is driven by aesthetic values. Thus, it is contemplated that variations in the design are possible that would provide a different aesthetic look and feel while still being within the scope of the present disclosure.

The mop 100 includes a shaft 120 which is connected to a mop head 130 that supports two opposing compression members 135. The compression members 135 may be shaped as desired, and in an embodiment may be shaped like a roller, as shown. In operation, a mop fiber base 142 may be provided in the mop head 130. The mop fiber base 142 is provided to support mop fibers 145, and the mop fiber base 142 is positioned between the opposing compression members 135. To help control the position of the mop fiber base 142, an actuator member 160, which may be a wire or a rod, is coupled to the mop fiber base 142.

The actuator member 160 extends a portion of a length of the shaft 120 and is also coupled to a handle 155 at coupling portion 155*b*. In operation, translation of the handle 155, which may be pivotally mounted to a support member (or pivot) 151 on a sleeve 150, causes the actuator member 160 to translate and as the actuator member 160 is coupled to the mop fiber base 142, this pulls the mop fiber base 142 through the compression members 135 so that mob fibers 145 are wrung. Thus, in operation, movement of the handle 155 from the first position in a first direction can pull the mop fiber 145 between the compression members 135 (in effect compressing the mop fibers 145) and movement of the handle 155 in an opposite direction reverses the process. In an embodiment, the mop 100 may be configured so that further movement of the handle 155 in the opposite direction beyond the first position moves the mop fiber base 142 into a replacement position, not shown. This allows the existing mop fiber base 142 to be decoupled from the actuator member 160 and a new mop fiber base 142 (with new mop fibers 145) to be coupled to the actuator member 160.

Figure 1B:
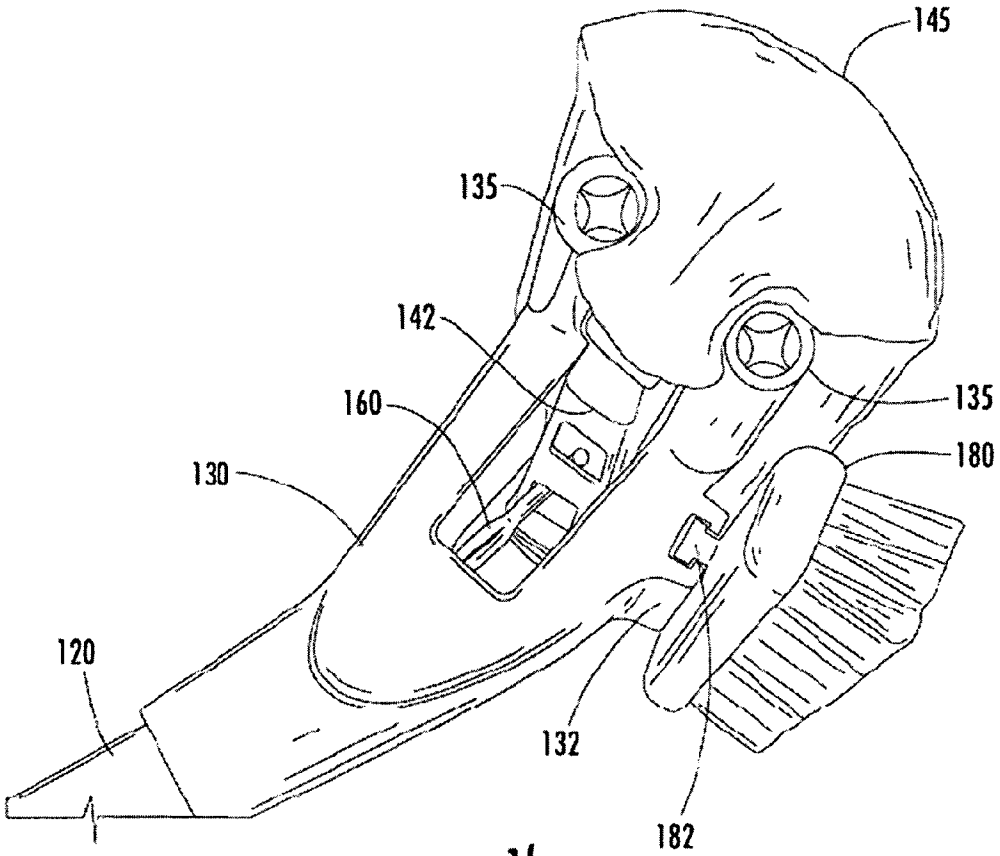
FIGS. 1*b*-1*d* illustrate partial isometric views of the mop depicted in FIG. 1*a*.
Figure 1C:
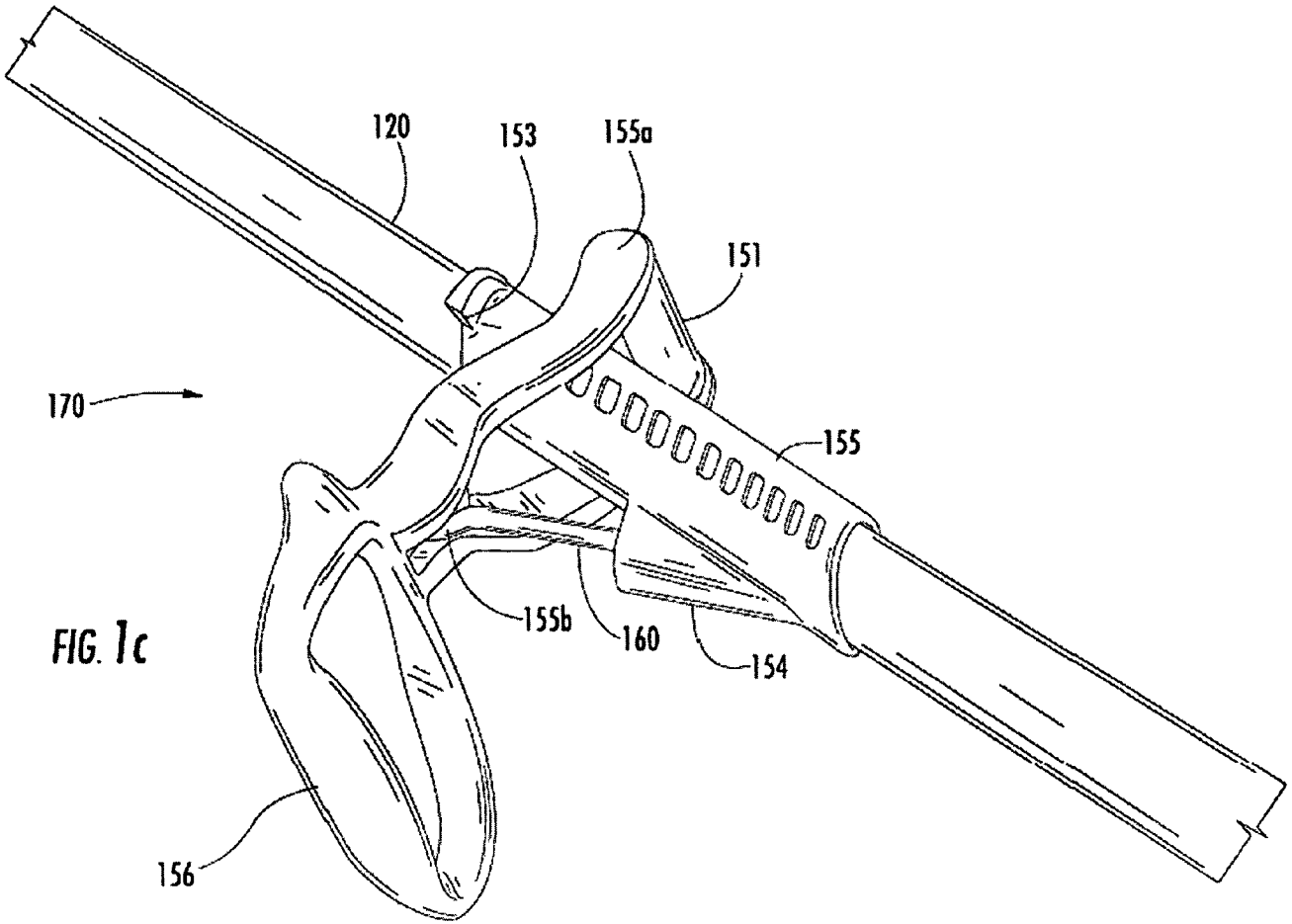
Figure 1D:
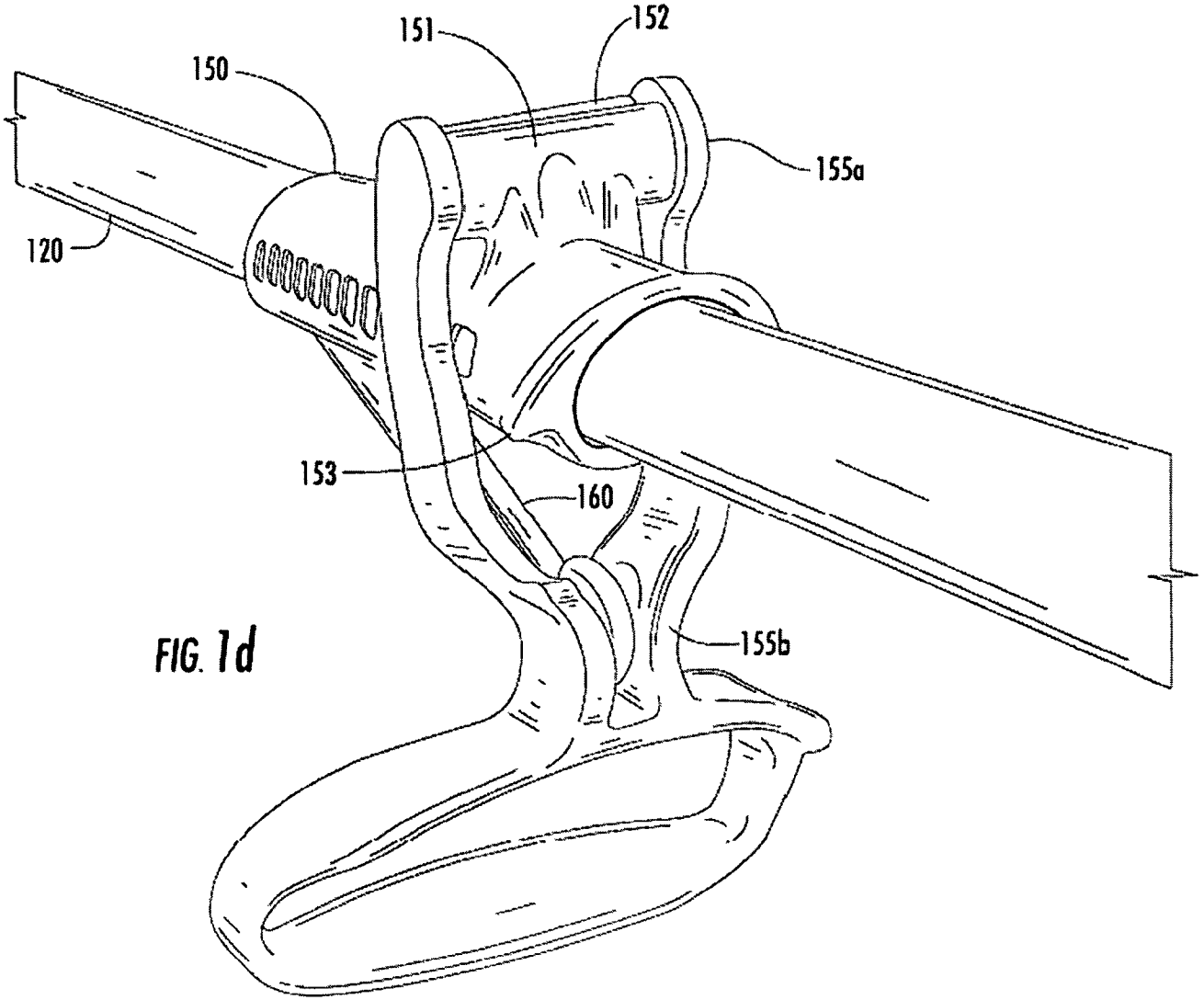

As can be appreciated from FIGS. 1*a* and 1*c*-1*d*, the handle 155, which may include a hand grip portion 156, is movably mounted to the pivot 151 on a first side of the shaft 120 while the actuator member 160 and the grip portion 156 are positioned on the opposite side of the shaft 120. The ratio of distance from the hand grip portion 156 to the handle portion 155*a* (where the handle 155 is pivotally mounted to the pivot 151) and the distance from the coupling portion 155*b* (where the handle 155 is coupled to the elongate member 160) to the handle portion 155*a* indicates the amount of leverage the handle 155 provides for wringing the mop fibers 145. Increasing the ratio decreases the amount of forced needed to move the handle 155 but also requires the handle 155 to be translated a greater distance in order to move the actuator member 160 (and the coupled mop fibers 145) the desired distance.

Figure 1E:
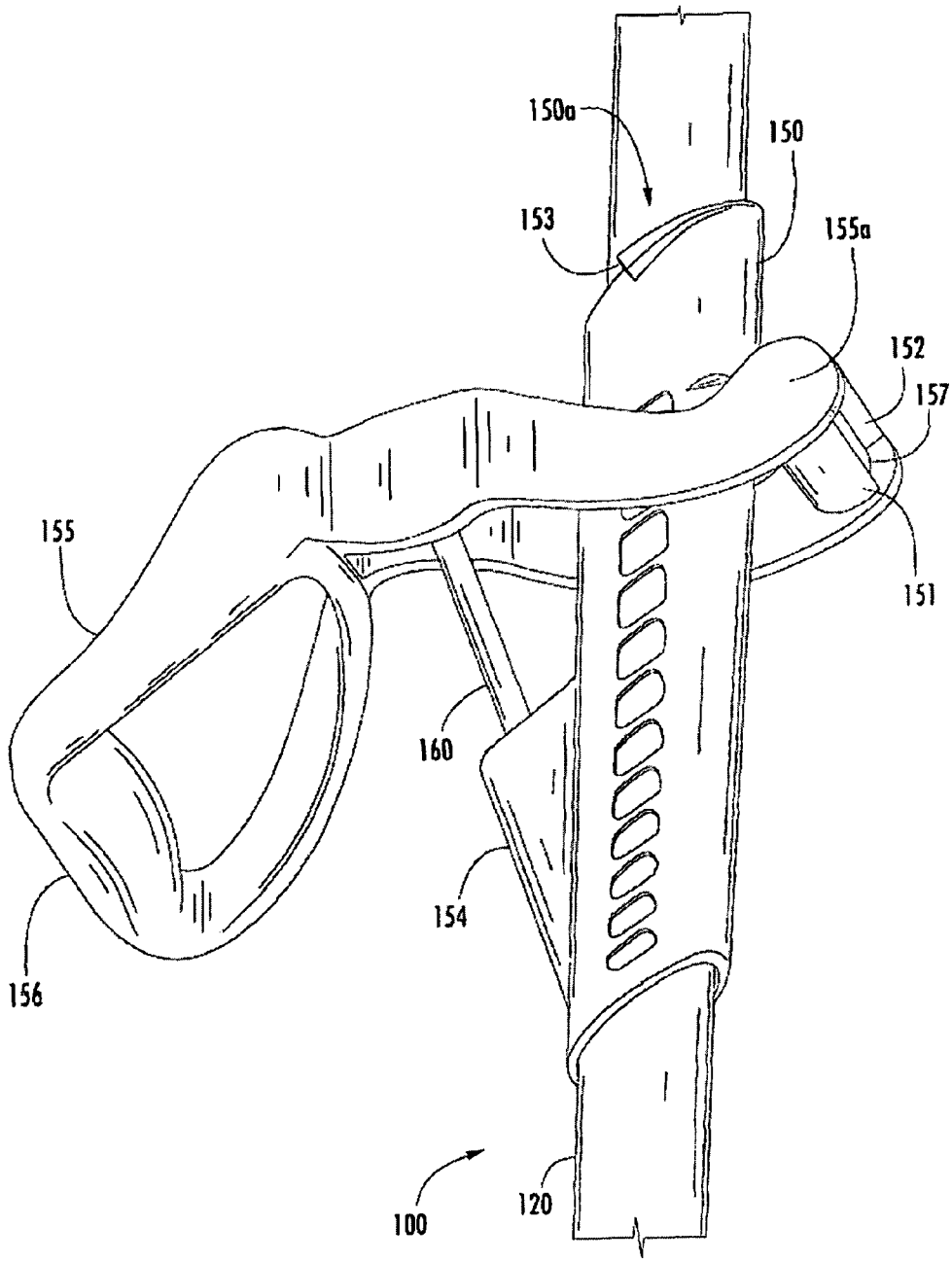
FIG. 1*e* illustrates a partial isometric view of an embodiment of a handle and sleeve coupled to a shaft, the handle in a first position.
Figure 2A:
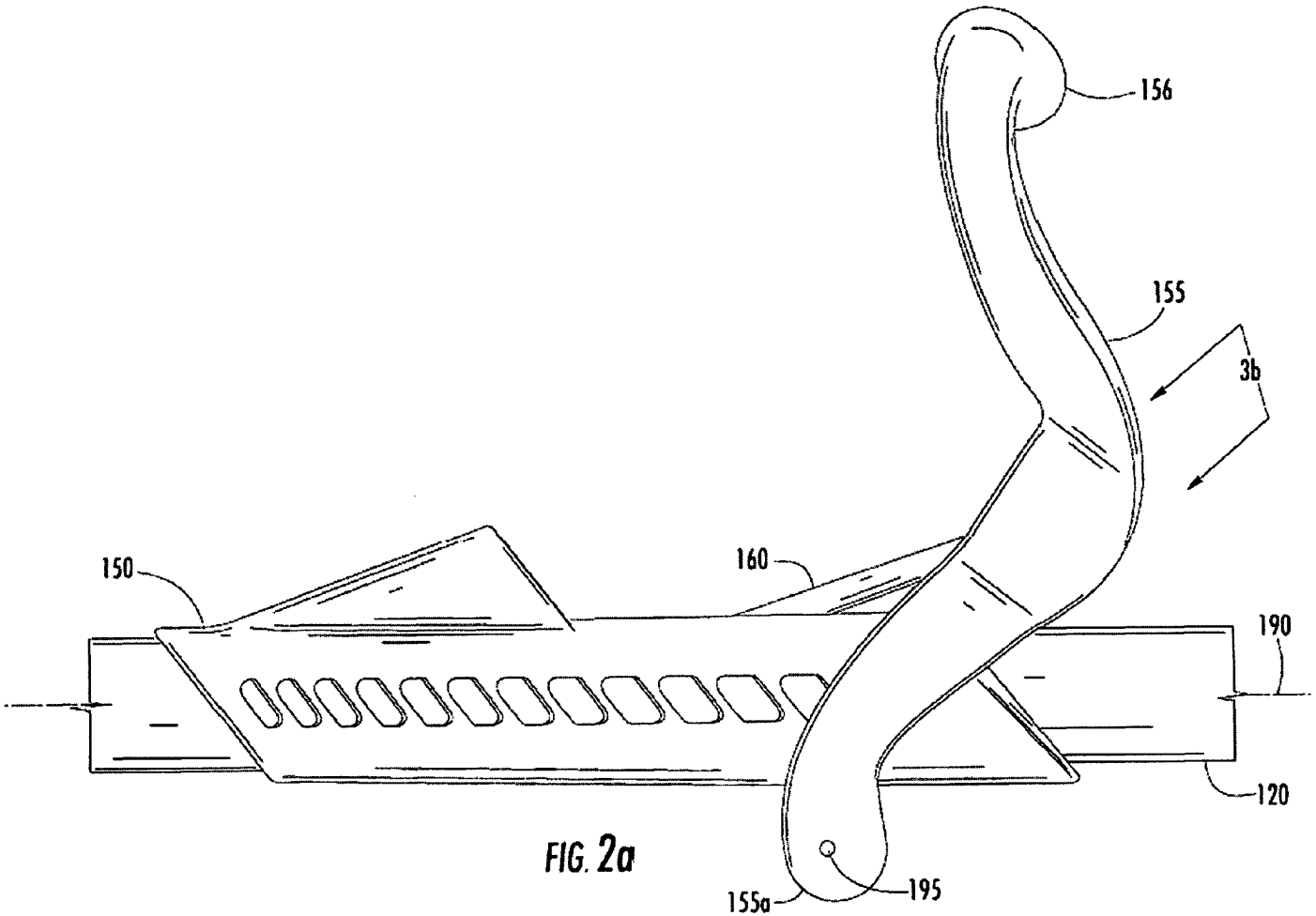
FIG. 2*a* illustrates a front partial view of the embodiment depicted in FIG. 1*e* with the handle in a second position.
Figure 2B:
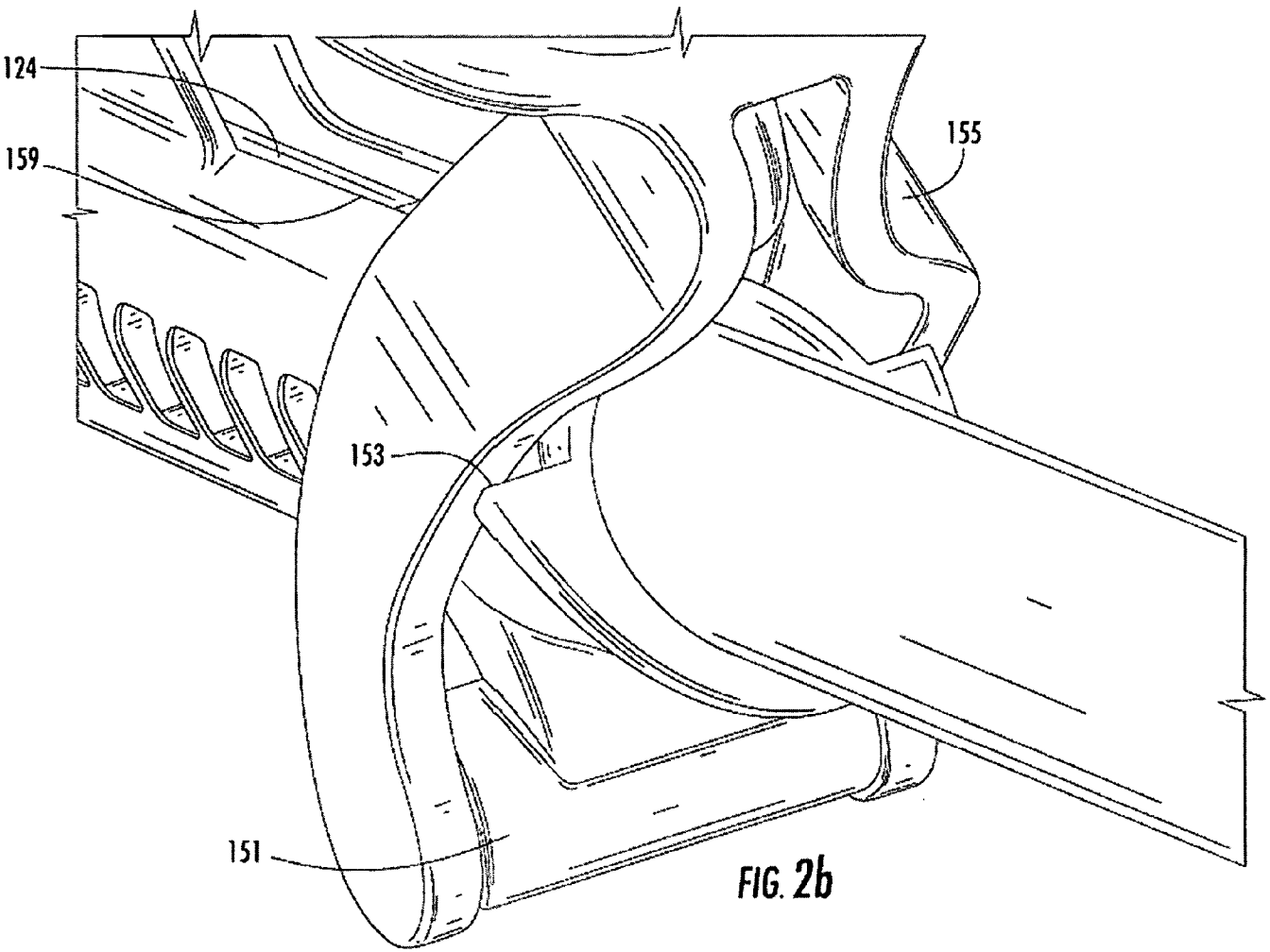
FIG. 2*b* illustrates an isometric partial view of the embodiment depicted in FIG. 2*a* with the handle engaging a stop.
Figure 5A:
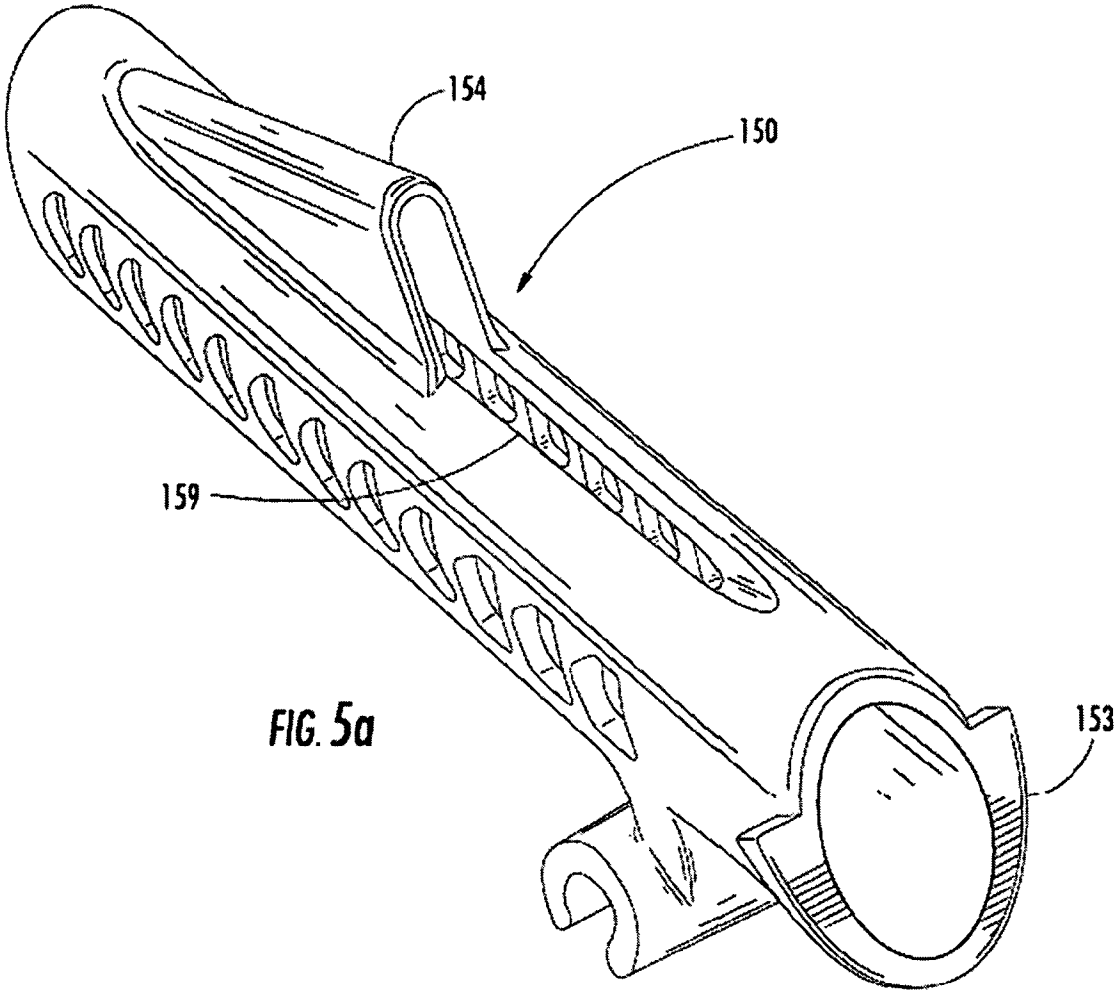
FIG. 5*a* illustrates an isometric view of an embodiment of a sleeve.
Figure 5B:
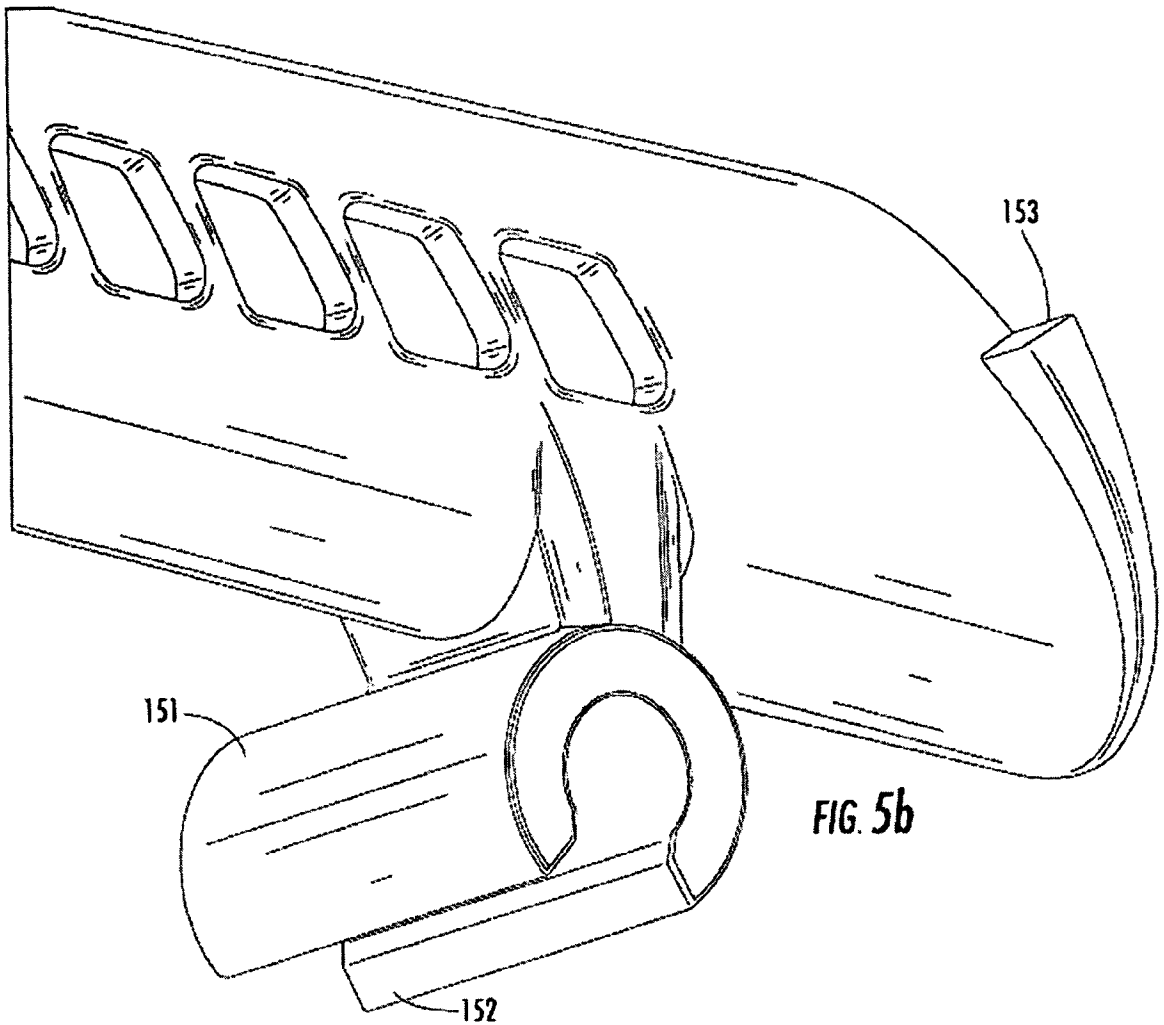
FIG. 5*b* illustrates a partial isometric view of the sleeve depicted in FIG. 5*a* and showing an embodiment of a pivot.

FIGS. 2*a*-2*b* illustrate the handle 155 in a second position with the handle pressed against the stop 153. Thus, a user may use the mop and when the user desires to wring the mop fibers 145, the user can translate the handle 155 from the first position (such as is shown in FIG. 1*e*) to the second position (such as is shown in FIG. 2*a*). As can be appreciated, pulling the handle (as opposed to pushing the handle) provides an ergonomic method of wringing the mop fibers 145 because it is easier to pull than push. Indeed, a user, in an attempt to ensure the fibers are fully wrung, may continue to exert force on the handle 155 in an attempt to translate the handle 155 beyond the intended range of movement. Because of the ergonomic design and the provided leverage, the user could potentially damage the mop 100. Therefore, a stop 153 may be provided to limit range of movement and prevent excessive translation of the handle 155. In an embodiment, as depicted, the stop 153 may be a truncated lip on an end 150*a* of the sleeve 150. (FIGS. 1*e* and 5*a*). In such a configuration, the stop 153, in addition to providing the benefits of preventing over-rotation, also has the benefit of being readily visible to the user so that user can readily appreciate that the handle 155 has been translated as far as it is intended to be moved.

As illustrated, the sleeve 150 is mounted to the shaft 120 and rotatably supports the handle 155 with the pivot 151. The handle 155 further comprises a hand portion 156 and a pivot portion 155*a*. The pivot 151 may be in the form of a cylindrical tube having a longitudinal slot 152 along its length. As can be appreciated, such a design allows a bar 157 on the pivot portion 155*a* of the handle 155 to be inserted in and supported by the pivot 151. The width of the slot 152 may be narrower than that of the bar 157 and the bar 157 may therefore only be located within the pivot 151 by widening the slot 152, which may be allowed due to the flexibility of the material the pivot 151 (and sleeve 150 in the case of an integral sleeve design) is manufactured from. This means that the handle 155 can be a single piece that can be assembled to the sleeve 150 without the use of additional fasteners. The hand grip 156 may be at or approximate an end 155*c* of the handle 155 in order to provide the maximum leverage.

Figure 3A:
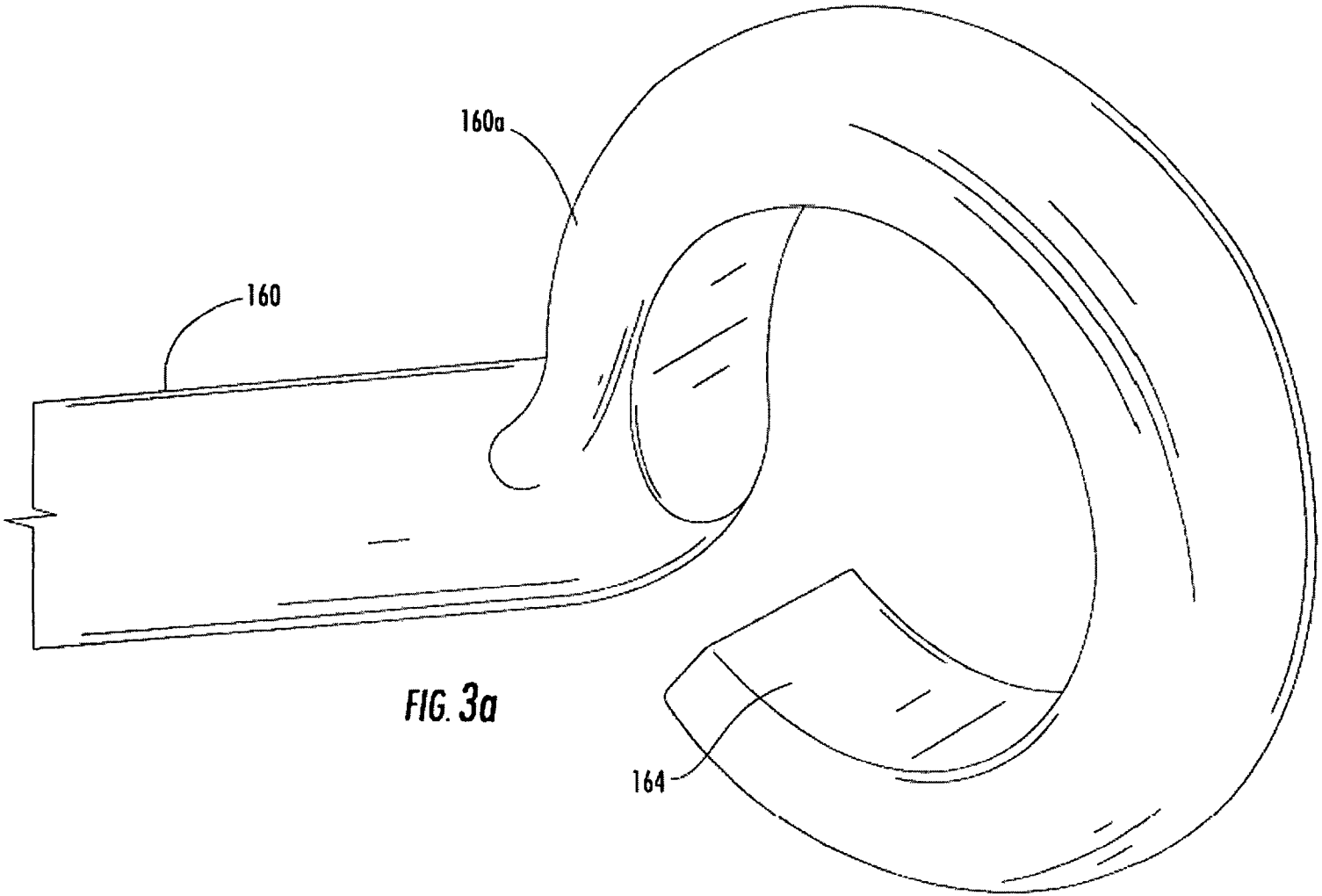
FIG. 3*a* illustrates an isometric partial view of an embodiment of an actuator member.
Figure 3B:
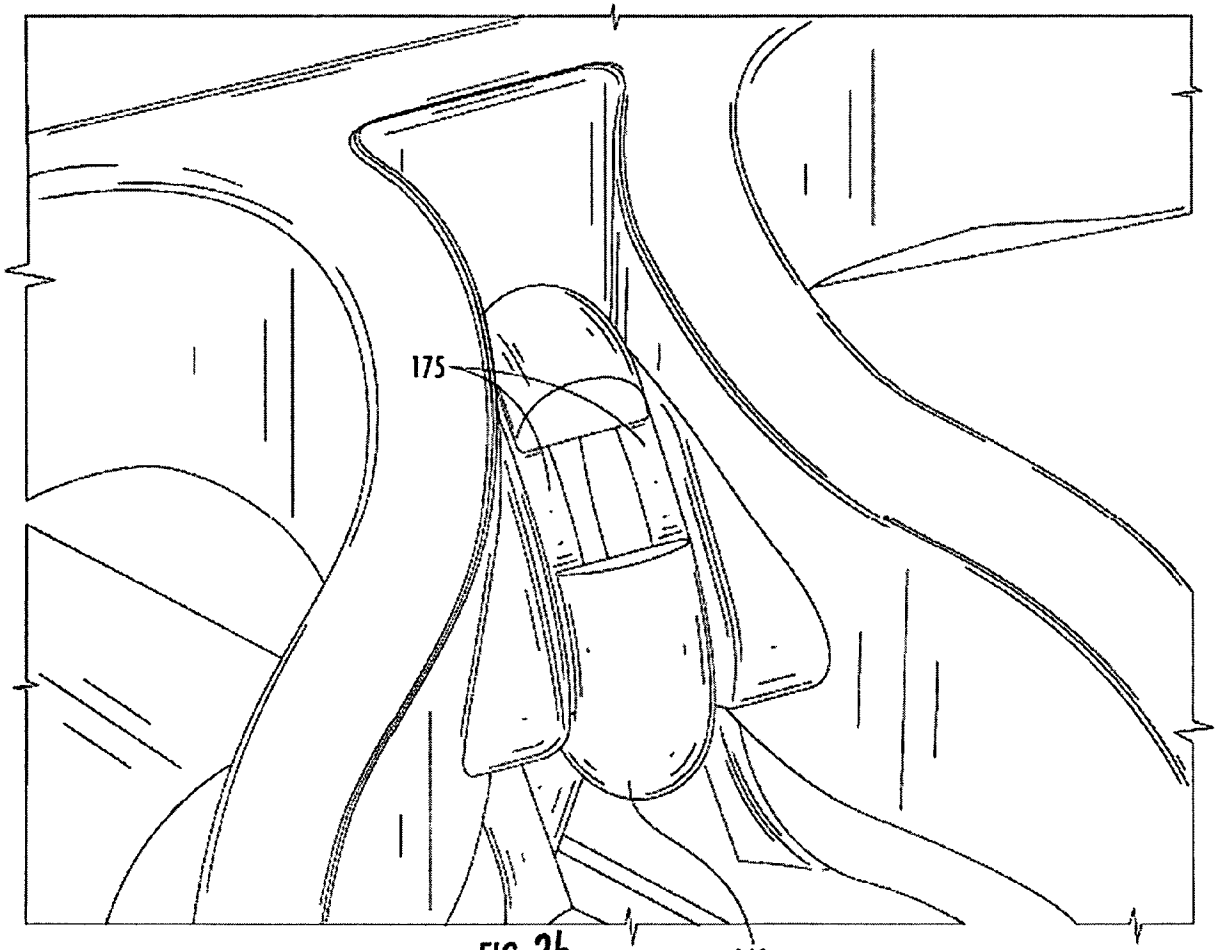
FIG. 3*b* illustrates an isometric partial cut-away view of an embodiment of an actuator member coupled to a handle.

The actuator member 160 is coupled to the handle 155 at the coupling portion 155*b* and the actuator member 160 may include a flat section 164 configured to be supported by split flat surface 175 of the handle 155. FIG. 3*b*, for example, illustrates an actuator member 160 coupled the handle 155 with a portion of the actuator member 160 removed to illustrate these details. In an embodiment, the split flat surface 175 is an integral part of the handle 155 and therefore a loop portion 160*a* of actuation member 160 can be coupled to the handle 155 without the need for a separate piece to support the actuator member 160. However, other means of connecting the actuator member 160 to the handle 155, such as the use of a conventional pin, may also be used.

It should be noted that in an embodiment, the handle 155 may be a single integrated piece that is molded or formed of a material such a plastic and is coupled to the actuator member 160 and the pivot 151 without the use of fasteners. The advantage of such a configuration is a potential improvement in quality and a beneficial reduction in the number of pieces used to manufacture the mop.

Figure 6:
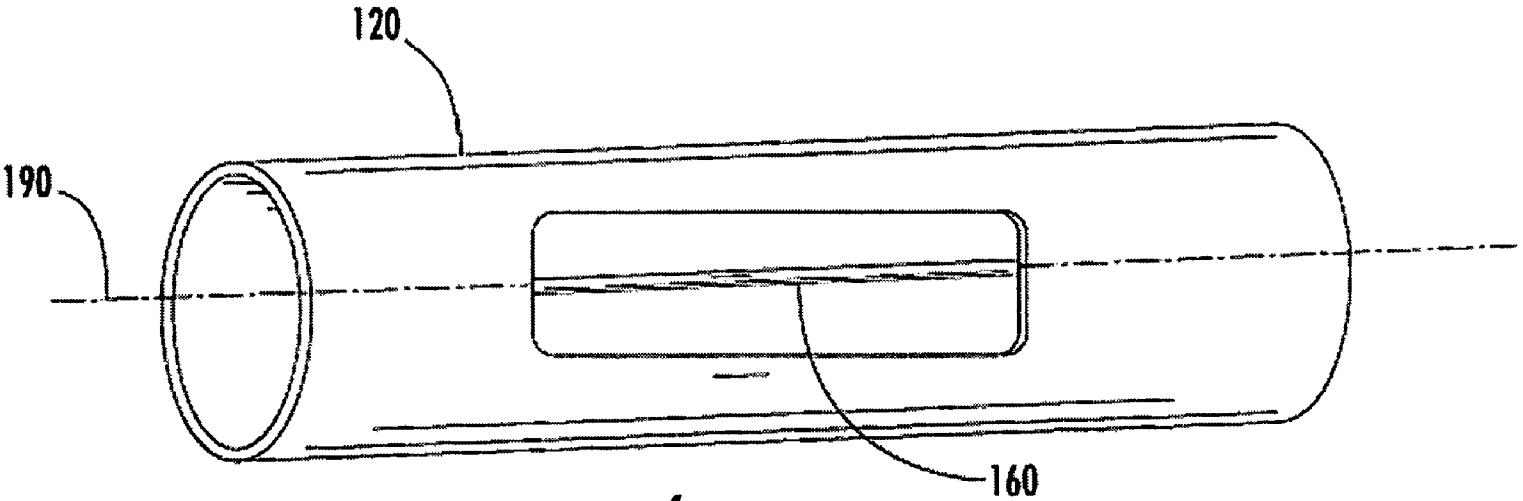
FIG. 6 is a schematic illustration of a cutout in a portion of a shaft with an actuator member extending through a hollow portion of the shaft.

The shaft 120 may be a tubular member with a hollow interior or section. In an embodiment, the actuator member 160 may pass down the hollow section in the shaft 120 and be removably coupled to the mop fiber base 142. (FIG. 6). A longitudinal slot 124 may be provided in the shaft 120 so as to allow the actuator member 160 to extend into the cavity of the shaft 120. In such a configuration, the sleeve 150 may include a channel 159 that is configured to correspond to the slot 124. (FIG. 5*a*). As can be appreciated, the longitudinal slot 124 allows the actuator member 160 to move through its range of motion when the handle 155 is rotated about the pivot 151. However, it will be apparent to one skilled in the art that is merely one example of a mop body and that other mop body structures may be used and fall within the scope of this disclosure.

As depicted, the pivot 151 includes an axis 195 that is designed to be offset from the longitudinal axis 190 of the shaft 120 on a first side of the shaft 120 and the actuator member 160 is mounted to the handle 155 on a second side of the shaft 120. As can be appreciated, such a configuration allows the actuator member 160 to be coupled to the handle 155 closer to the shaft 120 while still being a sufficient distance from the pivot 151 so as to provide an acceptable range of travel when the handle 155 is translated. A potential benefit of this configuration is that a better alignment between the actuator member 160 and the hollow cavity of the shaft 120 is possible. Therefore, there is a decreased tendency to experience undesirable levels of friction while sliding the actuator member 160 within the cavity of the shaft 120 while still providing the desirable amount of leverage for translating the mop fiber base 142 through the desired range of movement. In addition, it is possible to more directly apply the exerted force to the mop fiber base 142. Thus, for a given amount of leverage, less force should be needed to wring the mop fibers 145. Thus, it is possible to reduce the ratio of leverage while still requiring about the same amount of force due to the reduction in friction. In other words, the distance the handle 155 extends from the shaft 120 may be reduced while still providing an acceptable level of effort magnification. This makes the mop 100 easier to use and more compact since the handle 155 can extend a shorter distance from the center of the shaft 120 while still providing the same effective mechanical advantage. This can make it easier for a mop 100 to be used and stored without inadvertently making contact with the handle 155.

It should be noted that, in general, offsetting the pivot 151*a* distance away from the shaft 120 in order to increase the distance between the pivot 151 and the position where the actuator member 160 is mounted tends to require a greater force to translate the actuator member 160 due to the decrease in ratio (assuming the handle extends about the same distance from the shaft). It is believed however, that because of the improved alignment between the actuator member 160 and the shaft 120 and the mop fiber base 142, which is made possible by the depicted configuration, the level of force required to translate the handle 155 (and the coupled mop fibers 145) does not increase as much as would otherwise be expected.

A shroud 154 may also be provided on the sleeve 150. As with the stop 153, it is possible that the shroud may be integrated into the shaft 120. As depicted, the shroud 154 covers the region in which the actuator member 160 slides in and out of the slot in the shaft 120. This helps to prevent the ingress of debris into the shaft 120 through the slot and also helps to prevent things, such as fingers or clothing garments, from being trapped between the shaft 120 slot and the actuator member 160.

Figure 4:
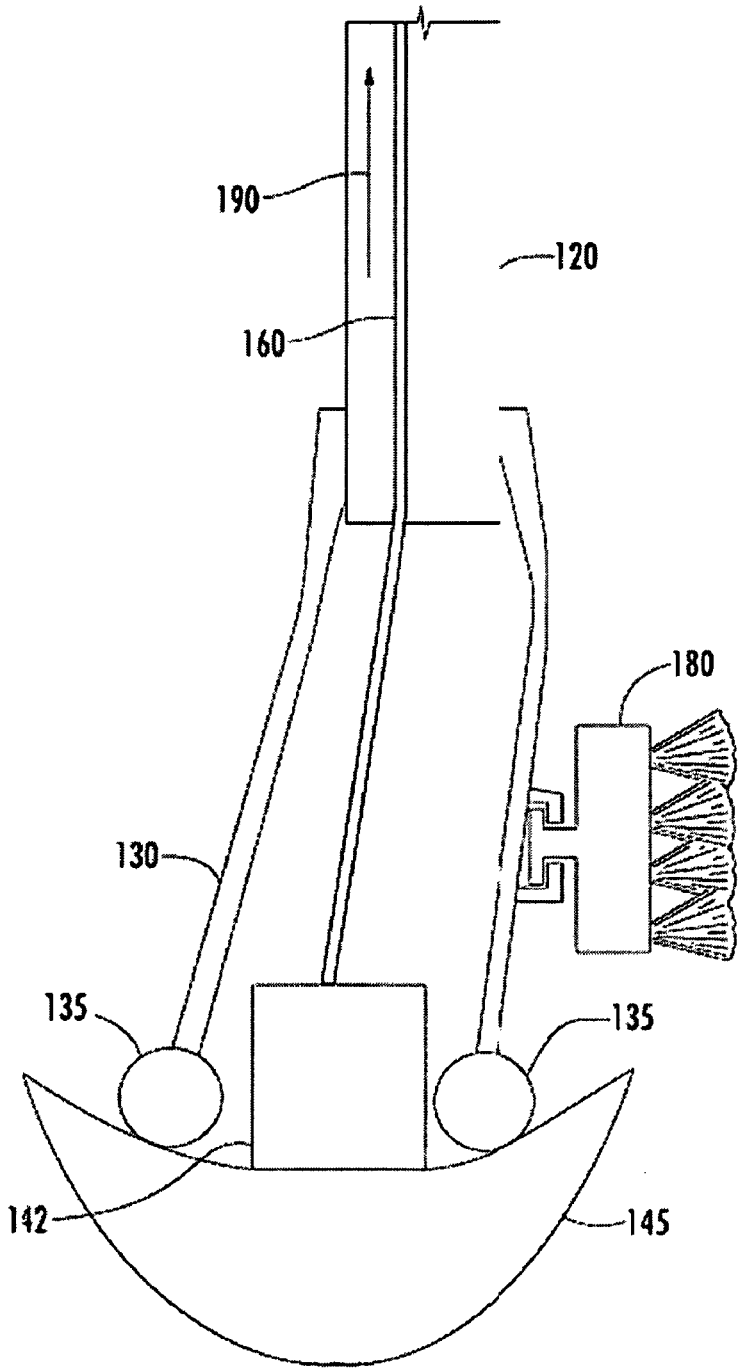
FIG. 4 illustrates a schematic of a cross section of an embodiment of a mop head coupled to a shaft.

FIG. 4 is a schematic of an exemplary embodiment and illustrates additional details of the mop body 130. As illustrated, the mop body 130 couples to the shaft 120 and supports first and second compression members 135. The compression members 135 may be shaped as desired but are depicted as cylindrical in shape. The mop body may further support an abrasive member 180 with a channel 132 that is configured to receive a T-shaped member 182 (FIG. 1*b*). It should be noted that in an embodiment, the channel 132 and the T-shaped member 182 can be configured so that once installed the abrasive member 180 cannot be readily removed. The actuation member 160 extends into the mop body 130 and couples to a mop fiber base 142 that supports and retains mop fibers 145. In operation, translation of the actuation member 160 causes the mop fibers 145 to pass the compression members 135, which are depicted as opposing compression members, so as to cause fluid in the mop fibers 145 to be expelled therefrom.

Figure 7:
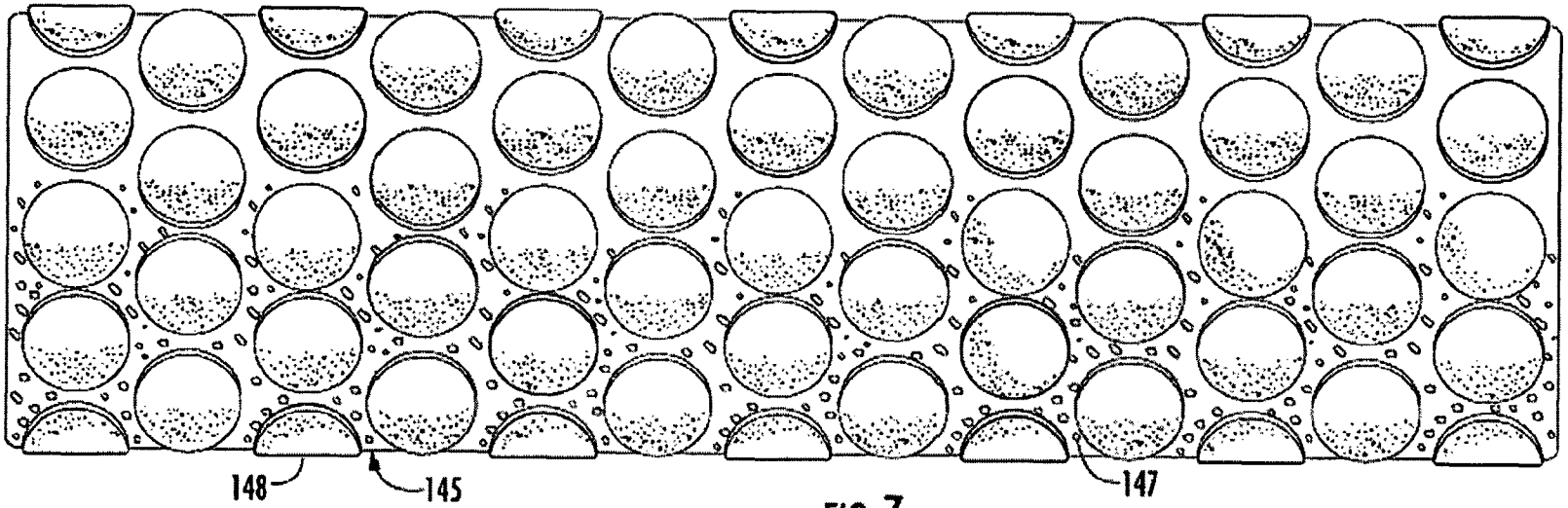
FIG. 7 illustrates a plan view of an embodiment of mop fibers with projections extending from a first surface.

In an embodiment, the mop fibers 145 may include surface projections 148 on a first surface 147, such as illustrated in FIG. 7. The surface projections 148, while not required, can enhance cleaning of a surface, including any grooves and recesses in a surface. The surface projections 148 may be constructed of the same material as the mop fibers 145 or they may be an alternative material or may be coated with a substance to give the surface projections 148 a different set of material properties than the remaining portions of the mop fibers 145. It should be noted that while the surface projections 148 are functional, the illustrated ratio between surface projections and the first surface (including the size, shape and spacing of the surface projections) is driven by aesthetic influences. It should be noted that mop fibers 145 may be a sponge-like material or other fibrous or porous material.

The materials used to construct the mop will depend on manufacturing preferences and cost issues and the choice of materials is not intended to be limiting. For example, but without limitation, the shaft 120 could be a metal alloy that may be painted or coated, the sleeve 150 could be a molded plastic part, the elongated actuator member 160 could be a metal alloy and the mop fibers 145 could be any material that is suitable for soaking up liquids while providing the desirable level of durability. In addition, selected materials maybe coated or painted as desired to provide the desired level of durability and to improve the overall appearance of the integrated mop.

The present invention has been described in terms of preferred and exemplary embodiments thereof. Variations including one or more of the depicted features may be provided. Numerous other embodiments, modifications and variations within the scope of the appended claims will occur to persons of ordinary skill in the art from a review of this disclosure.

What is claimed is:

1. A mop comprising:

a shaft;

a mop head attached to the shaft;

a sleeve mounted to the shaft, the sleeve including a pivot and a stop;

a handle rotatably coupled to the pivot, wherein the stop is configured to limit translation of the handle;

an actuator member coupled to the handle, the actuator member configured to couple to a mop fiber base, wherein, in operation, translation of the handle causes the actuator and the coupled mop fiber base to translate; and wherein the pivot is offset from the shaft so that the shaft is positioned between a location where the actuator member is coupled to the handle and the pivot.

2. The mop of claim 1, wherein the shaft includes a hollow section and the actuator member extends through the hollow section of the shaft down to the mop head.

3. The mop of claim 1, wherein the actuator member includes a flat surface for coupling to the handle.

4. The mop of claim 3, wherein the handle includes a split surface configured to support the flat surface of the actuator member.

5. The mop of claim 1, wherein the stop is a truncated lip on an end of the sleeve, wherein, in operation, pressing of the handle against the stop is readily visible to a user.

6. A method of using a mop, comprising:

introducing mop fibers supported by a mop fiber frame to liquid;

moving a handle from a first position, the handle coupled to an actuator member that extends between the handle and the mop fiber frame, the handle supported by a pivot mounted on a sleeve, wherein the sleeve is mounted on a shaft and wherein the pivot is offset from the shaft so that the shaft is positioned between a location where the actuator member is coupled to the handle and the pivot;

moving the handle to a second position, the second position causing the handle to press against a stop, the stop supported by the sleeve; and returning the handle to the first position.

7. The method of claim 6, wherein the moving of the handle to the second position causes the mop fibers to be squeezed between two opposing compression members.

8. The method of claim 7, wherein the moving of the handle causes a flat section of the actuator member to rotate about a flat surface of the handle.

9. The method of claim 7, wherein the pivot is positioned on an opposite side of the shaft as to where the actuator is coupled to the handle and the handle is configured to move in the substantially the same direction as the mop fibers.

10. A mop comprising:

a shaft with a hollow section and a slot;

a mop head coupled to the shaft, the mop head including two compression members;

a sleeve with a channel and a pivot, the channel of the sleeve positioned adjacent the slot, wherein the pivot is configured to be offset from the shaft;

a handle rotatably mounted to the pivot;

an actuator member mounted to the handle and configured to pass through the slot and channel and to extend through the hollow section of the shaft, wherein the pivot is positioned on a first side of the shaft and the actuator member is mounted on an opposite side of the shaft; and a mop body base supporting mop fibers and coupled to the actuator member, wherein, in operation, translation of the handle causes the actuator member to translate so as to translate the mop fiber base, the translation of the mop fiber base causing the mop fibers to be pulled through the compression members.

11. The mop of claim 10, wherein the mop fibers include a first surface and a plurality of projections extending from the first surface.

12. The mop of claim 11, wherein the sleeve includes a stop configured to limit rotation of the handle about the pivot.

13. The mop of claim 12, wherein the sleeve includes a shroud configured to partially cover the actuator member.

14. The mop of claim 13, wherein the shaft is located between the position where the handle is coupled to the actuator member and the position where the handle is mounted to the pivot.

15. A mop according to claim 13, wherein the actuator includes a flat section and the handle includes a split flat surface, wherein the split flat surface is configured to support the flat section of the actuator member.

* * * * *